US007442005B2

(12) United States Patent
Yeh et al.

(10) Patent No.: US 7,442,005 B2
(45) Date of Patent: Oct. 28, 2008

(54) FAN FRAME AND HEAT DISSIPATION FAN INCORPORATING THE FAN FRAME

(75) Inventors: Chin-Wen Yeh, Tu-Cheng (TW); Chin-Long Ku, Tu-Cheng (TW); Zhi-Jian Peng, Shenzhen (CN)

(73) Assignees: Fu Zhun Precision Industry (Shen Zhen) Co., Ltd., Shanzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,388

(22) Filed: Aug. 3, 2006

(65) Prior Publication Data

US 2007/0128022 A1 Jun. 7, 2007

(30) Foreign Application Priority Data

Dec. 2, 2005 (TW) ..... 94142467

(51) Int. Cl.
*F04D 29/54* (2006.01)

(52) U.S. Cl. ..... 415/200; 415/211.2; 415/220; 415/229; 417/354; 417/423.12; 417/423.14; 417/423.15; 417/423.7; 310/42; 310/43; 310/62; 310/63; 310/67 R; 310/90; 310/91

(58) Field of Classification Search ..... 415/185, 415/191, 208.2, 209.3, 209.4, 210.1, 211.2, 415/220, 222–223, 229, 200; 416/174; 417/354, 417/423.1, 423.7, 423.12, 423.14, 423.15; 310/42–43, 62–63, 67 R, 90–91
See application file for complete search history.

(56) References Cited

U.S. PATENT DOCUMENTS

| | | | | |
|---|---|---|---|---|
| 2,225,398 | A * | 12/1940 | Hamblin | 415/220 |
| 5,189,327 | A * | 2/1993 | Ootsuka et al. | 417/354 |
| 5,245,236 | A * | 9/1993 | Horng | 310/67 R |
| 6,000,919 | A * | 12/1999 | Hsieh | 417/423.15 |
| 7,118,333 | B2 * | 10/2006 | Takemoto | 415/211.2 |
| 2004/0096325 | A1 * | 5/2004 | Weisser | 415/220 |
| 2004/0141840 | A1 * | 7/2004 | Lin et al. | 415/220 |
| 2005/0232754 | A1 | 10/2005 | Ku et al. | |

FOREIGN PATENT DOCUMENTS

| | | | |
|---|---|---|---|
| CN | 2563334 | Y | 7/2003 |
| CN | 2695698 | Y | 4/2005 |
| CN | 2718283 | Y | 8/2005 |
| JP | 10304644 | A1 | 11/1998 |

* cited by examiner

*Primary Examiner*—Christopher Verdier
(74) *Attorney, Agent, or Firm*—Frank R. Niranjan

(57) ABSTRACT

A heat dissipation fan includes a fan frame, a stator mounted to the frame, and a rotor rotatably disposed around the stator. The fan frame includes a bracket, a central tube for positioning the stator, and a supporting member. The supporting member is made of a material having a higher bending strength than a plastic material used to form the bracket and the central tube. The supporting member includes a main body connected to the central tube, a plurality of ribs extending radially outwardly from the main body, and a plurality of engaging units formed at free ends of the ribs, respectively. The engaging units are embedded in the bracket for integrally connecting the central tube to the bracket.

20 Claims, 6 Drawing Sheets

FAN FRAME AND HEAT DISSIPATION FAN INCORPORATING THE FAN FRAME

1. FIELD OF THE INVENTION

The present invention relates generally to heat dissipation fans, and more particularly to a new and improved fan frame for use in connection with a heat dissipation fan typically intended for dissipating heat from electronic components.

2. DESCRIPTION OF RELATED ART

As technology continues to advance, it is inevitable that electronic components such as integrated circuits (ICs) will incorporate even larger numbers of transistors and other such components in their construction, and accordingly, these ICs will have an even higher level of heat emission. Thus it can be seen that, achieving a high enough level of heat dissipation problem in electronic components has become an obstacle affecting their further development and has to be addressed.

In order to reduce the high temperature resulting from operations of the electronic components, heat dissipation fans are commonly used. Conventional heat dissipation fans generally comprise a fan frame, a stator mounted in a middle portion of the fan frame and a rotor rotatable with respect to the stator.

The fan frames incorporated in conventional heat dissipation fans are generally made of plastic and comprise a bracket, a central tube located in a middle portion of the bracket for installing the rotor and the stator, and a plurality of ribs interconnecting the central tube and the bracket, the ribs being used for fastening the central tube in place.

During operation, the rotor rotates with respect to the stator at a high speed generating an airflow, whereby the heat generated by the electronic components can be dissipated by convection of the airflow. During the rotation of the rotor, eccentricities in rotation can cause the rotor to vibrate; this vibration may then be transmitted to the central tube. As a result, the central tube and the rotor may both suffer from vibration, thus producing a large amount of noise and possibly leading to metal-fatigue. Therefore, reducing vibration during the rotation of the rotor is a key point of current development.

It is therefore desirable to provide a heat dissipation fan with an improved fan frame capable of overcoming the above mentioned problems.

SUMMARY OF THE INVENTION

A heat dissipation fan according to a preferred embodiment of the present invention comprises a fan frame, a stator mounted to the fan frame, and a rotor rotatably disposed around the stator. The fan frame comprises a bracket, a central tube for positioning the stator, and a supporting member being made of metallic material having a higher bending strength than a plastic material used to form the bracket and the central tube. The supporting member comprises a main body connected to the central tube, a plurality of ribs extending radially outwardly from the main body, and a plurality of engaging units formed at free ends of the ribs, respectively. The engaging units are embedded in the bracket for integrally connecting the central tube to the bracket.

The advantages of this invention can be more readily ascertained from the following description of the invention when read in conjunction with the accompanying drawings, in which:

BRIEF DESCRIPTION OF THE DRAWINGS

Many aspects of the present heat dissipation fan can be better understood with reference to the following drawings. The components in the drawings are not necessarily drawn to scale, the emphasis instead being placed upon clearly illustrating the principles of the present heat dissipation fan. Moreover, in the drawings, like reference numerals designate corresponding parts throughout the several views.

DETAILED DESCRIPTION OF THE INVENTION

Figure 1:
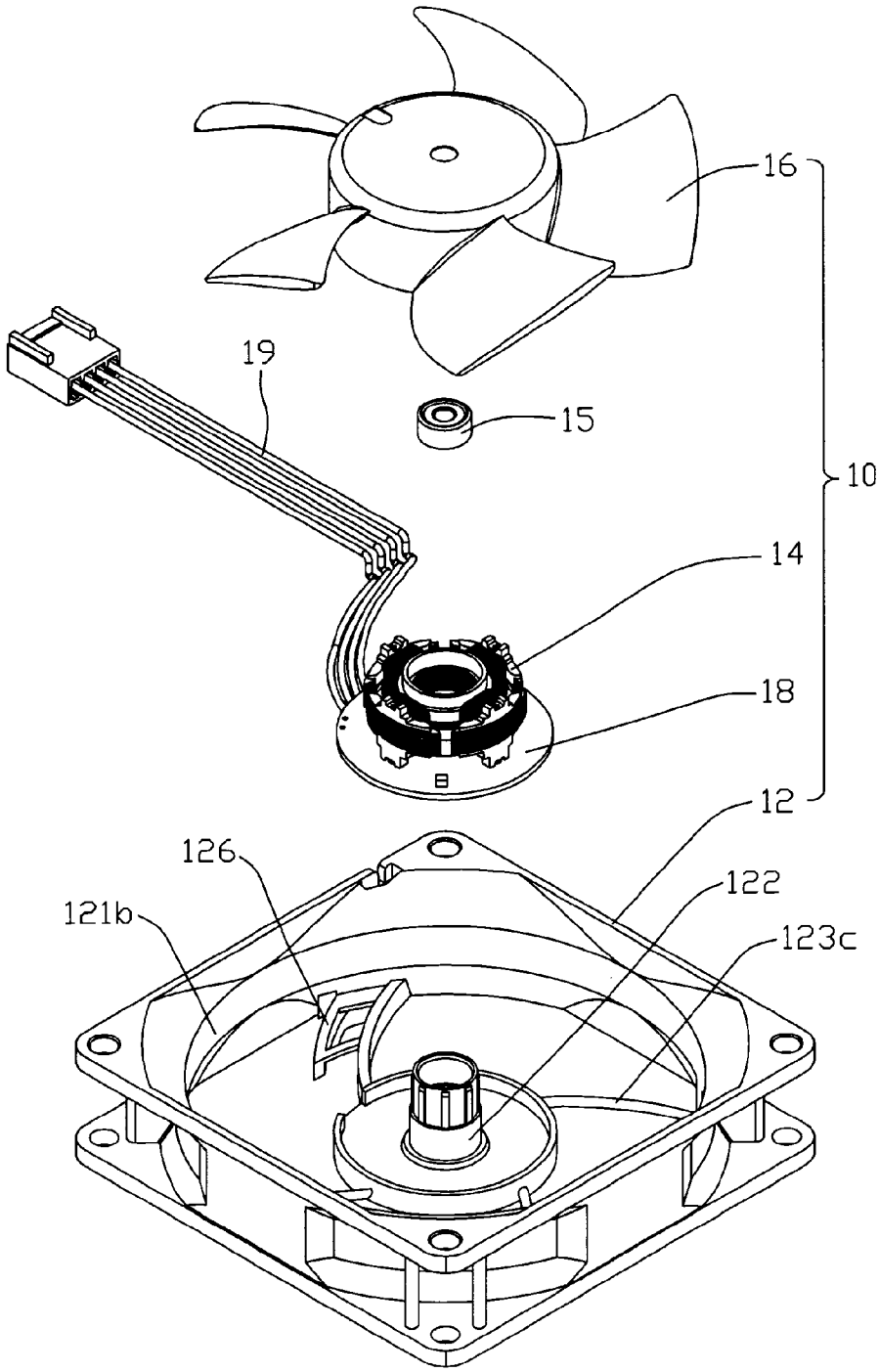
FIG. 1 is an exploded, isometric view of a heat dissipation fan in accordance with a preferred embodiment of the present invention.
Figure 2:
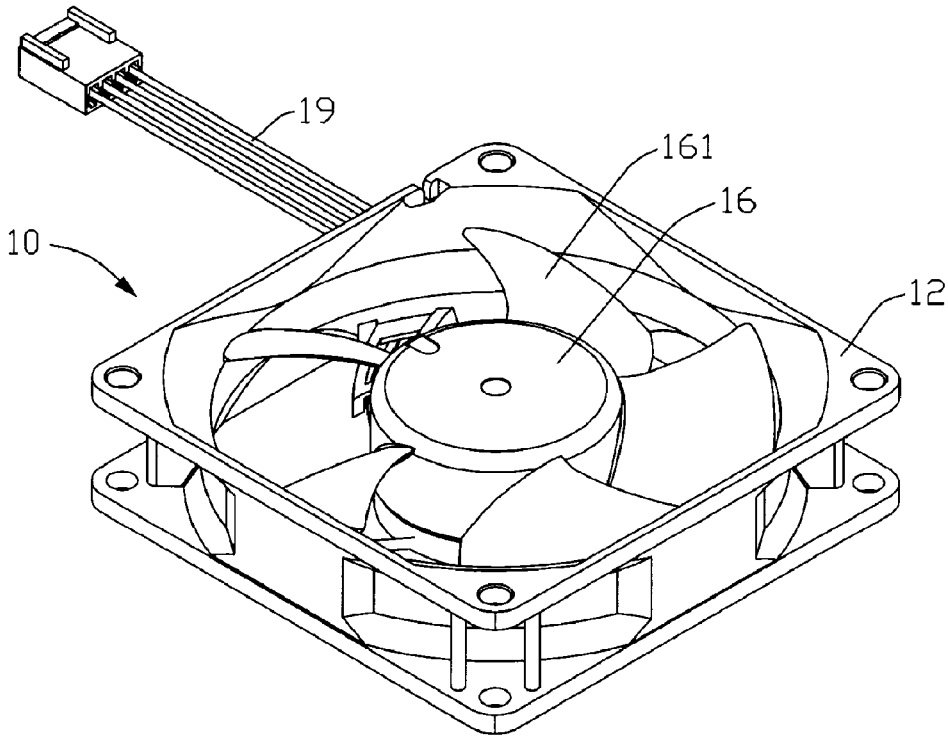
FIG. 2 is an assembled, isometric view of the heat dissipation fan of FIG. 1.

Referring to FIGS. 1-2, a heat dissipation fan 10 in accordance with a preferred embodiment of the present invention comprises a fan frame 12, a stator 14 mounted to the fan frame 12 and a rotor 16 rotatably disposed around the stator 14.

Figure 3:
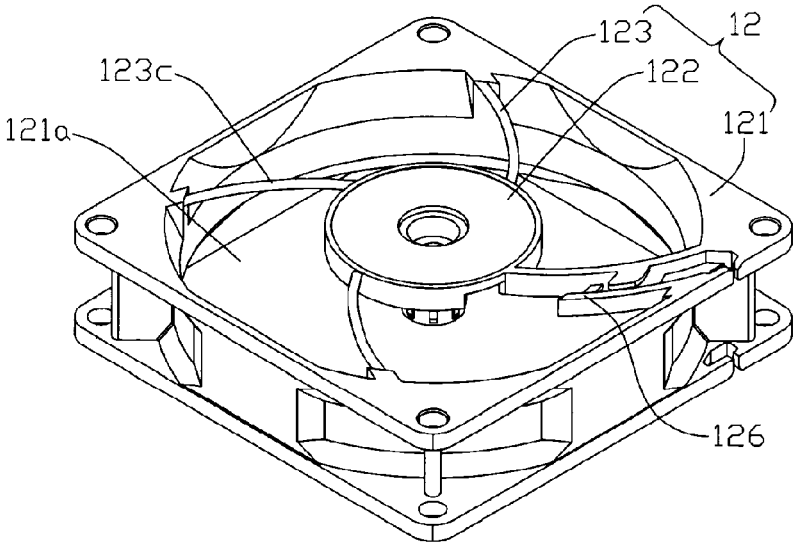
FIG. 3 is an isometric view of a fan frame of the heat dissipation fan of FIG. 1, shown in an upside-down manner.

Referring to FIG. 3, the fan frame 12 is comprises a rectangular bracket 121, a central tube 122 located in the bracket 121 and a supporting member 123 interconnecting the bracket 121 with the central tube 122. The bracket 121 is molded from a plastic material, and includes an air inlet 121*b* (see FIG. 1) and an air outlet 121*a*. The air inlet 121*b* and the air outlet 121*a* are located at opposite sides of the bracket 121, wherein the air outlet 121*a* is located adjacent to the central tube 122. The central tube 122 is a hollow tubular unit and is also molded from a plastic material. The central tube 122 is located at middle portion of the bracket 121, extending from the air outlet 121*a* toward the air inlet 121*b*. The stator 14 is mounted around the central tube 122, while the rotor 16 is mounted to the central tube 122 via a bearing system 15. The bearing system 15 is received in the central tube 122 and the rotor 16 has a shaft (not visible) rotatably supported in the bearing system 15. Thus the rotor 16 is rotatable in the bracket 121 when the fan 10 operates. The rotor 16 has a plurality of blades 161 extending radially outwardly from an outer periphery of a hub (not labeled) thereof. A printed circuit broad (PCB) 18 is located at a bottom portion of the stator 14. The PCB 18 is electrically connected to a power supply (not shown) through a group of electrical wires 19. The electrical wires 19 provide electric power to drive the rotor 16 to rotate at high speeds. The bearing system 15 can be a self-lubricating bearing system, for supporting rotation of the rotor 16 therein. During high speed rotation of the rotor 16, the blades 161 cooperatively generate an airflow flowing from the air inlet 121*b* towards the air outlet 121*a*; thus, heat generated by heat-generating electronic components can be dissipated by the airflow.

Figure 4:
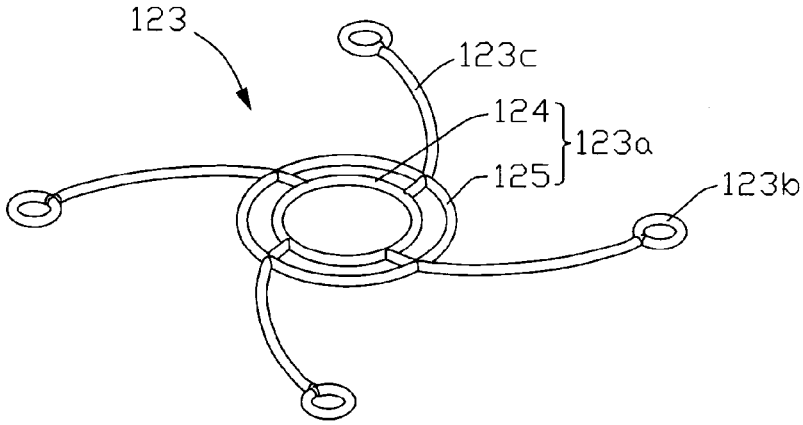
FIG. 4 is a cross-sectional isometric view of a supporting member of the fan frame of FIG. 3.

Referring also to FIG. 4, the supporting member 123, which connects the bracket 121 with the central tube 122, is used for securing the central tube 122 in place. The supporting member 123 is made of a metallic material having a higher mechanical bending strength than the plastic material of which the bracket 121 or the central tube 122 is made. An electrical insulating layer (not labeled) covers an outer surface of the supporting member 123 so as to render the supporting member 123 thermally conductive but electrically insulated. The electrical insulating layer may be a layer of insulating material coated on the outer surface of the supporting member 123. The metallic material used to form the supporting member 123 can be copper alloy, aluminum alloy, ferroalloy or any other suitable metallic materials having a relatively high mechanical strength. Thus, though the supporting member 123 is not electrically conductive, it is heat conductive.

The supporting member 123 comprises a main body 123*a* fixed to the central tube 122, a plurality of engaging units 123*b* fixed to the bracket 121 and a plurality of ribs 123*c* each interconnecting the main body 123*a* with a corresponding engaging unit 123*b*. The main body 123*a* comprises at least one circular ring. In this embodiment, the main body 123*a* comprises two concentric circular rings 124, 125, which have different radii and are spaced from each other. The ribs 123*c* extend radially outwardly from the inner circular ring 124 to the outer circular ring 125 and then extend outwardly from the outer circular ring 125, thus connecting the two circular rings 124, 125 together to form an integral unit. The main body 123*a* is attached to the central tube 122, the engaging units 123*b* are fixed to the bracket 121, and the ribs 123*c* extend between the central tube 122 and the bracket 121. Thus, the supporting member 123 fixedly secures the central tube 122 at the middle portion of the bracket 121. The main body 123*a* of the supporting member 123 has at least a portion exposed to environment. Preferably, an outer surface of the outer circular ring 125 of the main body 123*a* is at the same level as an outer surface of the central tube 122, so that the outer surface of the outer circular ring 125 is exposed to environment. The main body 123*a* preferably contacts an underside of the PCB 18 directly; thus, heat generated by electronic parts (not shown) mounted on the PCB 18 is able to be conducted to the main body 123*a* and then dissipated into the environment efficiently.

Figure 5:
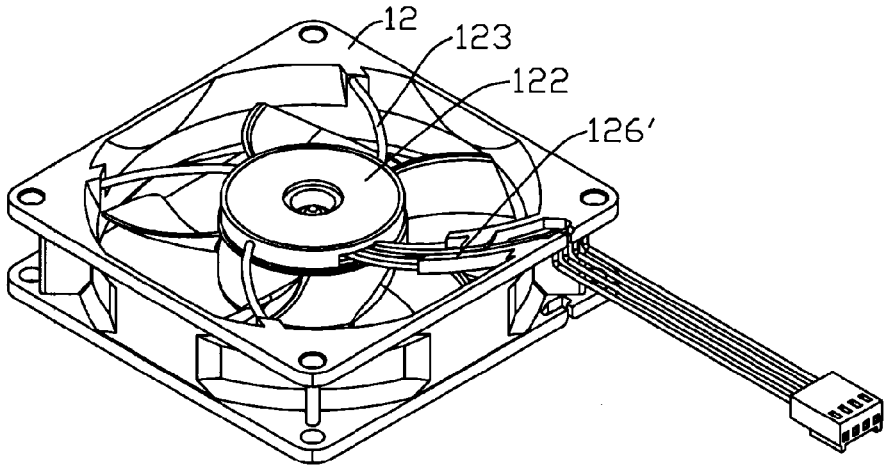
FIG. 5 is an assembled, isometric view of a heat dissipation fan according to a second embodiment of the present invention, as shown in an upside-down manner.

The ribs 123*c* are arc-shaped. A curvature of each of the ribs 123*c* is similar to that of each of the movable blades 161 of the rotor 16. The arc-shaped ribs 123*c* are configured for guiding the airflow to flow out of the bracket 121 through the air outlet 121*a*, and the ribs 123*c* improve the mechanical strength between the bracket 121 and the central tube 122. A trough 126 is connected to one of the ribs 123*c* for receiving the electric wires 19 therein, as shown in FIG. 3. The trough 126 is made of plastic, and covers at least a portion of the particular rib 123*c*. In this embodiment, the trough 126 covers an outside of the particular rib 123*c*. The trough 126 covers a whole length of the particular rib 123*c*. As an alternative embodiment shown in FIG. 5, the trough 126' covers only a portion of the particular rib 123*c* to which the trough 126' is connected.

Each of the engaging units 123*b* is a ring formed at a free end of each rib 123*c*. The engaging units 123*b* and the main body 123*a* are fixed to the bracket 121 and the central tube 122, respectively using, a molding process (i.e., insert molding) used to produce the bracket 121 and the central tube 122. Specifically, when the fan frame 12 and the central tube 122 are molded, the molten molding material flows to cover the engaging units 123*b* and the main body 123*a*, whereby the engaging units 123*b* are wholly received in the bracket 121 and the main body 123*a* is received in the central tube 122 after the molding material is solidified. The ring-shaped engaging units 123*b* help to prevent the supporting member 123 from disengaging from the bracket 121.

In the above described embodiments, since the main body 123*a* is partially exposed to the environment and thermally contacts with the PCB 18, the heat generated by the electronic parts of PCB 18 is able to be conducted to the supporting member 123 and further be dissipated into the environment. Hence, the PCB 18 can operate at a relatively low working temperature. Since the supporting member 123 is made of metallic material, the ribs 123*c* of the supporting member 123 have good bending strength, so that the ribs 123*c* of the supporting member 123 are not deformed considerably when subject to external forces. The mechanical strength between the bracket 121 and the central tube 122 is improved efficiently; thus, the vibration caused by rotation of the rotor 16 is diminished, and the noise of the heat dissipation fan 10 is greatly reduced. Since the metallic material of the ribs 123*c* have a higher bending strength than the plastic material used to form the bracket 121 and the central tube 122, the metallic ribs 123*c* can be made smaller than ribs made of plastic material, given the same mechanical strength requirement. The smaller-sized ribs 123*c* can reduce the resistance of the airflow passing through the ribs 123*c*, thus increasing the heat dissipation efficiency of the heat dissipation fan 10.

Figure 6:
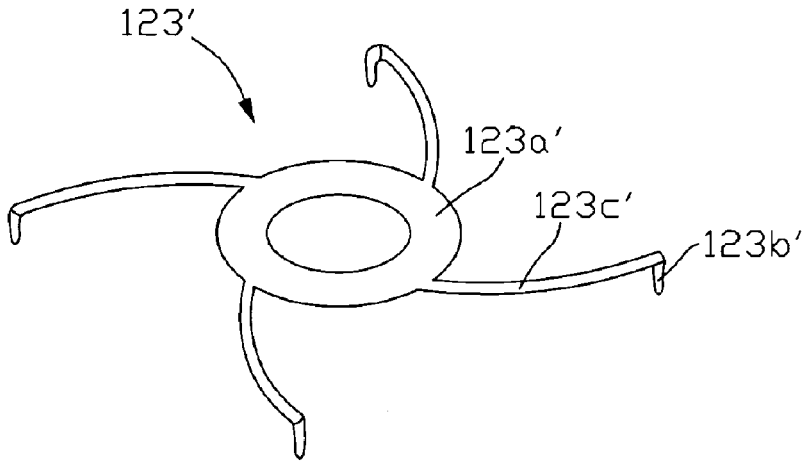
FIG. 6 is an isometric view of a supporting member of a fan frame according to a further alternative embodiment of the present invention.

Understandably, the supporting member 123 as shown in the above described embodiment can be presented in other forms. As an alternate embodiment shown in FIG. 6, the main body 123*a'* is a thin, round board having a central hole (not labeled) defined therein, and the engaging unit 123*b'* is a bending segment extending downwardly from a free end of each rib 123*c'*, wherein the bending segments of the engaging units 123*b'* can prevent the supporting member 123' from disengaging from the bracket 121 of the heat dissipation fan 10 after the bracket 121 is and the supporting member 123' are insert molded together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fan frame comprising:

a bracket;

a central tube mounted in a middle portion of the bracket, the bracket made of plastic material; and a supporting member made of metallic material, interconnecting the central tube and the bracket, the supporting member made of the metallic material having a higher bending strength than the plastic material used to form the bracket, the supporting member comprising a main body connecting with the central tube, a plurality of ribs extending radially outwardly from the main body, and a plurality of engaging units each respectively formed at a free end of the ribs, and engaged with the bracket.

2. The frame as described in claim 1, wherein the supporting member is made of a material chosen from the group consisting of aluminum alloy, copper alloy, and ferroalloy.

3. The frame as described in claim 1, wherein the supporting member, the bracket and the central tube are integrally formed by insert molding.

4. The frame as described in claim 1, wherein an outer surface of the main body is at the same level as an outer surface of the central tube so that the outer surface of the main body is exposed to the environment.

5. The frame as described in claim 1, wherein the main body comprises two concentric circular rings, the ribs being arc-curved and extending from a periphery of an inner circular ring of the two rings.

6. The frame as described in claim 1, wherein the main body is a thin round board having a central hole therein.

7. The frame as described in claim 1, wherein each of the engaging units is a ring.

8. The frame as described in claim 1, wherein each of the engaging units is a bending segment extending downwardly from a corresponding rib.

9. A heat dissipation fan comprising:

a fan frame comprising a bracket made of plastic material, a central tube mounted in a middle of the bracket and a supporting member inter-connecting the bracket and the central tube, the supporting member made of a material having a higher bending strength than the plastic material used to form the bracket, comprising a main body combining with the central tube, a plurality of ribs extending radially outwardly from the main body and a plurality of engaging units, each respective engaging unit formed at a respective free end of the ribs and engaging with the bracket;

a stator positioned around the central tube; and a rotor rotatable with respect to the stator.

10. The heat dissipation fan as described in claim 9, wherein the supporting member is made of a metallic material.

11. The heat dissipation fan as described in claim 9, wherein the fan frame is integrally formed by insert molding.

12. The heat dissipation fan as described in claim 9, wherein an outer surface of the main body is at the same level as an outer surface of the central tube, and the main body thermally contacts with a circuit board located under the stator.

13. The heat dissipation fan as described in claim 9, wherein the main body has one of the following configurations: two concentric circular rings and a thin, round board having a central hole therein.

14. The heat dissipation fan as described in claim 9, wherein each of the engaging units has one of the following configurations: a ring and a bending segment.

15. The heat dissipation fan as described in claim 9, wherein a trough is connected to one of the ribs for securing electric wires of the heat dissipation fan, the trough covering at least a portion of the one of the ribs.

16. A fan frame for a heat dissipation fan, comprising:

a bracket made of plastic material;

a central tube located in the middle of the bracket and made of plastic material;

a supporting member made of metallic material, having a main body, a plurality of ribs extending radially outwardly from the main body and a plurality of engaging units each formed at a free end of a corresponding rib; wherein the main body of the supporting member is insert molded with the central tube, the engaging units are insert molded with the bracket and the main body of the supporting member has at least a portion exposed to environment.

17. The fan frame as described in claim 16, wherein the main body of the supporting member includes at least one circular ring and the engaging units each are ring-shaped.

18. The fan frame as described in claim 16, wherein the main body of the supporting member includes a thin, round board, and the engaging units each are a bending segment extending downwardly from the free end of the corresponding rib.

19. The fan frame as described in claim 16, wherein the ribs each have a curved configuration.

20. The fan frame as described in claim 16, wherein one of the ribs is connected with a trough adapted for receiving electric wires therein.

* * * * *